United States Patent [19]

Dunton

[11] Patent Number: 4,841,098

[45] Date of Patent: Jun. 20, 1989

[54] HIGH POWER RADIO FREQUENCY ENERGY FEEDTHROUGH FOR HIGH VACUUM VESSEL

[75] Inventor: Arthur R. Dunton, Englewood, Fla.

[73] Assignee: Insulator Seal, Inc., Englewood, Fla.

[21] Appl. No.: 204,393

[22] Filed: Jun. 9, 1988

[51] Int. Cl.[4] ..... H01B 17/30; H01B 17/54

[52] U.S. Cl. ..... 174/15.3; 174/18

[58] Field of Search ..... 174/9 R, 15.3, 18, 152 E; 313/30, 42, 43

[56] References Cited

U.S. PATENT DOCUMENTS 2,465,369 3/1949 Gibson ..... 174/15.3

2,863,934 12/1958 Tudbury ..... 174/15.3 X

*Primary Examiner*—Laramie E. Askin

*Attorney, Agent, or Firm*—David B. Harrison

[57] ABSTRACT

A fluid cooled feedthrough, for conducting electrical energy at high power levels through a wall of a pressure or vacuum vessel includes a mounting flange for mounting the feedthrough to a mating flange formed at a wall of the vessel. The mounting flange includes a seal for sealing the flange to the mating flange in a high pressure/vacuum sealing arrangement. An insulator tube is secured to the mounting flange in a high pressure/-vacuum sealing arrangement. A conductor tube is secured to the insulator tube at a bonding region at an outer end thereof, and the conductor tube conducts electrical energy at high power levels and carries cooling fluid therethrough. The conductor tube defines at least one interior cooling fluid flow passage directly adjacent to the bonding region for conducting away the heat generated at the region incident to the passage of the electrical energy at high power levels. The insulator tube insulates the conductor tube from the mounting flange and from the wall.

9 Claims, 1 Drawing Sheet

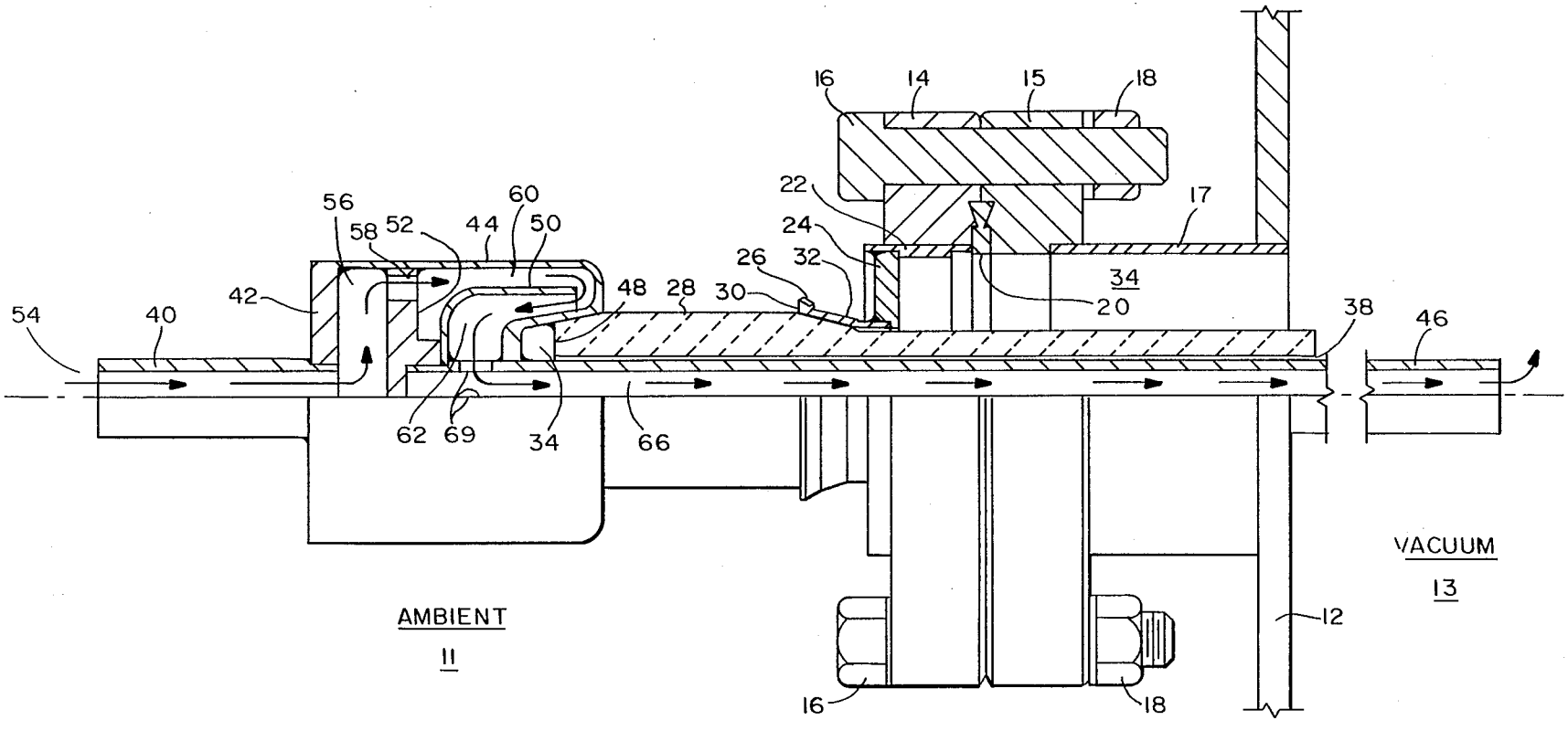
VACUUM
13
AMBIENT
11
46
38
12
17
18
34
20
15
14
16
22
24
32
26
30
28
48
66
50
60
44
52
58
56
42
40
54
62
69

HIGH POWER RADIO FREQUENCY ENERGY FEEDTHROUGH FOR HIGH VACUUM VESSEL

FIELD OF THE INVENTION

The present invention relates to a feedthrough for passing energy through a wall of a pressure resistive vessel, such as a high vacuum vessel. More particularly, the present invention relates to a fluid-cooled, high power radio frequency energy feedthrough for a high vacuum pressure vessel.

BACKGROUND OF THE INVENTION

High power feedthroughs for passing electrical and radio frequency (RF) energy through walls, bulkheads, etc., are known. Such feedthroughs typically comprise an insulative material, such as ceramic, mounted to a flange extending from the wall at a location surrounding an opening therethrough. The insulator typically supports and spaces a conductor away from the flange/-wall structure by a sufficient distance to prevent arc-over. Such arrangements work well, unless a hostile environment is presented on one side of the wall, such as an extremely high pressure or vacuum contained within a hermetically sealed pressure or vacuum vessel.

As is well known to those skilled in the art, a skin effect causes most RF current to flow in the outermost region of a conductor. It is in this peripheral region of a cylindrical conductor that electronic resistance and inductive heating is also concentrated.

A prior approach to feeding RF energy at high power levels through to the interior of a high vacuum vessel was to bond a hollow RF conductor tube to an outwardly concentric ceramic insulator and then pass cooling fluid through the conductor tube in order to conduct heat generated electronically within the conductor tube away to a suitable heat exchange/dissipation apparatus. The drawback presented by this prior approach was that the ceramic-to-conductor tube bond because highly stressed due to the tremendous thermal gradient thereacross, leading directly to mechanical failure.

Thus, a hitherto unsolved need has arisen for an effective high power RF feedthrough for pressure or vacuum vessels which enables cooling fluid to flow directly adjacent to the insulator-to-conductor bond region, thereby providing requisite cooling to the bond region and extending considerably the useful life of the feedthrough.

SUMMARY OF THE INVENTION WITH OBJECTS

A general object of the present invention is to provide a fluid cooled feedthrough for conducting electrical energy at high power levels through a wall of a pressure or vacuum vessel in a manner which overcomes the limitations and drawbacks of the prior art.

A specific object of the present invention is to provide a fluid cooled high power feedthrough for pressure/vacuum vessels which is readily manufacturable and which provides a long useful life without mechanical failure or electrical breakdown.

A further specific object of the present invention is to provide a fluid cooled high power feedthrough which may be made of readily available materials employing presently available fabrication techniques.

One more specific object of the present invention is to provide a fluid cooled high power RF feedthrough for pressure/vacuum vessels which concentrates cooling fluid flow at the outer peripheral regions throughout a central conductor tube to maximize heat transfer from the peripheral regions generated there by skin effect.

A fluid cooled feedthrough, for conducting electrical energy at high power levels through a wall of a pressure or vacuum vessel in accordance with the principles of the present invention, includes a mounting flange for mounting the feedthrough to a mating flange at the wall of the vessel. The mounting flange includes a seal for sealing the flange to its mating flange in a high pressure/vacuum sealing arrangement. An insulator tube is secured to the mounting flange in a high pressure/-vacuum sealing arrangement. A conductor tube is secured to the insulator tube at a bonding region at an outer end thereof, and the conductor tube conducts electrical energy at high power levels and carries cooling fluid therethrough. The conductor tube defines at least one interior cooling fluid flow passage directly adjacent to the bonding region for conducting away the heat generated at the region incident to the passage of the electrical energy at high power levels. The insulator tube insulates the conductor tube from the mounting flange and from the wall.

In one aspect of the present invention, the conductor tube comprises an outer baffle and an inner baffle which cooperate to define the interior cooling fluid flow passage directly adjacent to the bonding region.

In a related aspect, the outer baffle and the inner baffle define a plurality of interconnected chambers; a region of interconnection between the chambers defines the interior cooling fluid flow passage adjacent to the bonding region.

In another aspect of the present invention, the insulator tube defines a generally frustroconical surface at the bonding region and the conductor tube defines structure for surrounding the frustoconical surface in a mating arrangement.

In a further aspect of the present invention, the conductor tube includes a segment disposed axially within and spaced away from the insulator tube.

In one more aspect of the present invention, the insulator tube includes a frustoconical segment located intermediate the ends thereof and the mounting flange includes a bell-shaped flange portion in which the frustoconical segment is secured in axial alignment and is bonded thereto.

In a related aspect the bell-shaped flange includes a cylindrical segment extending to a mounting flange portion of the mounting flange, the cylindrical segment being spaced away from the insulator tube passing therethrough.

In a still further aspect of the present invention, the flange includes an annular chiselpoint seal for deforming ductile sealing material as the chiselpoint seal is forced into sealing proximity with respect to the wall of the pressure/vacuum vessel.

In one more aspect of the present invention, the electrical energy is at a radio frequency and the interior cooling fluid flow passage formed directly adjacent to the bonding region also extends directly adjacent to the outer surface of the conductor tube throughout its extent within the feedthrough in order to draw off heat generated at the outer surface due to skin effect of the radio frequency energy.

These and other objects, advantages, aspects and features of the present invention will become more fully understood and appreciated by considering the following detailed description of a preferred embodiment, presented in conjunction with the accompanying drawing. The wall of the high vacuum vessel is broken off in order to conserve drawing room.

BRIEF DESCRIPTION OF THE DRAWING

The FIGURE depicts a fluid cooled, high power RF feedthrough for a high vacuum vessel in accordance with the principles of the present invention. The feedthrough is shown in elevation, and the upper half of the elevation is in section along the longitudinal axis to illustrate the internal configuration of the feedthrough. The illustrative feedthrough is mounted to a partially sectioned mating flange extending outwardly from a sidewall of the high vacuum vessel.

DETAILED DESCRIPTION OF A PREFERRED EMBODIMENT

With reference to the FIGURE, a fluid cooled, high power RF feedthrough 10 for passing high power, on the order of 35 kilowatts or greater of RF energy at frequencies lying in the high frequency spectrum, through a sidewall 12 of a high vacuum vessel is depicted. The left portion of the feedthrough 10 is located in the external ambient environment 11, and the right portion of the feedthrough 10 is located within the interior 13 of the high vacuum vessel. Typically the RF feedthrough 10 acts as a transmission line for delivering high power energy to e.g. inductive heating loads contained within the high vacuum vessel.

A stainless steel annular flange 14 is attachable to a mating flange 15 which terminates an outer end of a cylindrical stainless steel tube portion 17 extending from the wall 12 of the high vacuum vessel. The tube 17 is e.g. TIG welded to the sidewall 12 and to the mating flange 15. The annular flange 14 is secured to the mating flange 15 in sealing engagement by suitably tightened bolts 16 with threaded ends and mating nuts 18, for example. An annular chiselpoint seal 20 may be formed by a lathe bit in the flange 14; it cooperates with a suitable annular sealing gasket, typically formed of a ductile metal, such as copper, and the outer surface of the mating flange 15 in order to provide a reliable high vacuum seal between the flange 14 and the wall 12. A preferred form of seal is illustrated and discussed in U.S. Pat. No. 4,681,329, the disclosure of which is incorporated herein by reference.

The flange 14 is TIG welded to a cylindrical metal part 22. The cylindrical part 22 is vacuum brazed to an outer periphery of an annular disk 24; and, the disk 24 is vacuum brazed to bell-shaped flange 26. The flange 26 has a tapered, frustoconical inside surface at a location where it is vacuum brazed to an elongated ceramic tube insulator 28, and a cylindrical segment 32 extending to a mounting flange portion of the annular disk 24, this cylindrical segment being spaced away from the insulator tube 28 which passes therethrough. While a braze ring 30 is shown in the FIGURE, it is to be understood that brazing occurs throughout the facing contact surfaces of the ceramic and metal elements. Preferred brazing materials to bond e.g. copper and ceramic include silver-copper-eutectic or silver-copper-palladium, for example.

The ceramic tube insulator 28 is formed with a mating frustoconical outer surface at the region of the braze ring 30 in order to achieve a press-tight fit during fabrication and to provide considerable compressive load strength to withstand the compressive force of the bell-shaped flange 26 which is pressed very tightly over the ceramic insulator 28. The copper flange 26 is typically nickel plated to prevent the copper from going into solution during the brazing cycle.

The frustroconical arrangement between the bell-shaped flange 26 and the ceramic insulator 28 provides an excellent compromise between the need to provide adequate mechanical mounting rigidity for the ceramic insulator and any different coefficients of thermal expansion between the flange 26 and the insulator 28 which otherwise set up inadequate sealing parameters as the parts are heated to e.g. 850 degrees Centigrade at which the brazing occurs and then cooled to ambient.

In practice, metals and alloys are selected with coefficients of expansion closely following that of the ceramic insulator material. Matching of the expansion coefficients of electromagnetic or non-magnetic sealing alloy to high aluminum oxide ceramics enables hermetic seals to be achieved which preserve the integrity of the hermetically sealed portion of the feedthrough. In order to accommodate vacuum brazing and to minimize difference in thermal coefficients for use with high aluminum oxide content ceramic insulators, the flange 26 and metal portions of the feedthrough 10 other than the stainless steel mounting flange 14 are preferably formed of a ductile material such as oxygen free high conductivity copper.

The insulator 28 is typically formed of 95% aluminum oxide ceramic material; and, it extends outwardly from the flange 26 for a distance selected to provide adequate insulation given the potential of the radio frequency energy relative to the sidewall 12, e.g. ten thousand volts per inch. The insulator 28 also extends inwardly through the plane of the sidewall 12.

As seen in the FIGURE, the high vacuum environment, denoted by the reference numeral 34, extends through the opening in the sidewall 12 and also extends in a narrow annular gap or band 36 separating the outer wall of the insulator 28 and the inside of the bell-shaped flange 26. Another elongated annular gap or band 38 separates the inside cylindrical wall of the ceramic insulator tube 28 from the outer cylindrical wall of a central RF conductor tube portion 46.

An outer RF conductor inlet tube portion 40 is vacuum brazed to an outer cylindrical plate 42. The plate 42 is vacuum brazed to an outside cylindrical baffle 44 which is spun into the geometry illustrated in the sectioned part of the FIGURE. The inner end of the baffle 44 is vacuum brazed to the central RF conductor tube portion 46; and, an intermediate, frustroconical portion is vacuum brazed at rings 48 to the symmetrical outer end of the ceramic insulator tube 28. An inner cylindrical cup baffle 50 and an inner plate 52 are both joined to the central RF conductor tube portion 46. The inner cylindrical plate 52 is vacuum brazed to the inside wall of the outer baffle 44 as shown in the FIGURE.

The inlet tube portion 40 defines a cooling fluid inlet 54 through which cooling fluid such as distilled water (denoted by the arrows in the FIGURE) flows. The cooling fluid passes through the interior of the inlet tube portion 40 until a first chamber 56 is encountered.

The first chamber 56 is defined by the outer plate 42, an outward annular segment of the baffle 44 and the inner plate 52. A plurality of holes 58, such as eight holes, are defined through the inner plate 52 in equally spaced apart relationship at locations adjacent to the outer baffle 44. These holes 58 enable the cooling fluid to pass into a second interior chamber 60 defined by the inner plate 52, outer baffle 44 and the inner cylindrical cup baffle 50.

The baffle 50 acts as a nozzle, and forces the cooling fluid to flow most rapidly through a narrowed passage directly adjacent to the joint between the outer baffle 44 and the ceramic insulator 28, thereby drawing off the electronic heating otherwise induced at that location by passage of the high power RF. The cooling fluid then enters a third interior chamber 62 defined by the inner cylindrical cup baffle 50, interior region of the outer baffle 44 and central RF conductor tube portion 46.

A plurality of holes 64 defined through the central RF conductor portion adjacent to the third interior chamber 62 enable the cooling fluid to flow into a fourth, central fluid flow chamber 66 which extends throughout the central RF conductor tube portion 46. Once the cooling fluid has exited the central RF conductor tube portion 46, other coolant flow passages (not shown) return the cooling fluid to the heat exchange apparatus in the external ambient 11.

Typically, two feedthroughs 10 are provided for a single vessel in order to provide a balanced RF transmission line and also to provide a suitable fluid flow path for the cooling fluid. Although fluid flow has been shown as entering the feedthrough 10 from the external ambient 11 and leaving via the central tube portion 46 within the vacuum area 13, it is to be understood that the fluid may flow in the opposite direction with equally satisfactory results. A minimum fluid flow rate of e.g. four gallons per hour may be accommodated if the inlet tube portion 40 and central tube portion 46 have inside diameters of 0.375 inch and if the openings 58 and 64 are appropriately sized.

To those skilled in the art to which the present invention relates, many changes and widely differing embodiments will suggest themselves without departure from the spirit and scope of the present invention. The disclosures herein are purely illustrative of the invention, the scope of which is more particularly set forth in the following claims.

I claim:

1. A fluid coolable feedthrough for conducting electrical energy at high power levels through a wall of a pressure or vacuum vessel, the feedthrough comprising:

mounting flange means for mounting the feedthrough to flange mating means formed at the wall of the vessel, the mounting flange means including sealing means for sealing the flange means to the flange mating means in a pressure or vacuum sealing arrangement, insulator tube means secured to said mounting flange means in a pressure or vacuum sealing arrangement, conductor tube means secured to said insulator tube means at a bonding region at an outer end thereof for conducting said electrical energy at high power levels and for carrying cooling fluid therethrough, said conductor tube means defining at least one interior cooling fluid flow passage directly adjacent to said bonding region for conducting away the heat generated at said region incident to the passage of said electrical energy at high power levels, said insulator tube means being for insulating said conductor tube means for said mounting flange means and from said wall.

2. The fluid coolable feedthrough set forth in claim 1 wherein said conductor tube means comprises an outer baffle and an inner baffle, said outer baffle and said inner baffle cooperating to define said interior cooling fluid flow passage directly adjacent to said bonding region.

3. The fluid coolable feedthrough set forth in claim 1 wherein said conductor tube means comprises an outer baffle and an inner baffle defining a plurality of interconnected chambers, a region of interconnection defining said interior cooling fluid flow passage adjacent to said bonding region.

4. The fluid coolable feedthrough set forth in claim 1 wherein said insulator tube means defines a generally frustoconical surface at said bonding region and said conductor tube means defines structure for surrounding said frustoconical surface in a mating arrangement.

5. The fluid coolable feedthrough set forth in claim 1 wherein said conductor tube means includes a segment disposed axially within and spaced away from said insulator tube means.

6. The fluid coolable feedthrough set forth in claim 1 wherein said insulator tube means includes a frustoconical segment located intermediate the ends thereof and wherein said mounting flange means includes a bell-shaped flange in which said frustoconical segment is secured in axial alignment and bonded thereto.

7. The fluid coolable feedthrough set forth in claim 6 wherein said bell-shaped flange includes a cylindrical segment extending to a mounting flange portion of said mounting flange means, said cylindrical segment being spaced away from said insulator tube means passing therethrough.

8. The fluid coolable feedthrough set forth in claim 1 wherein said sealing means includes an annular chiselpoint seal and ductile sealing material sealingly deformed as said chiselpoint seal is forced into sealing proximity with respect to said flange mating means at said wall.

9. The fluid coolable feedthrough set forth in claim 1 wherein said electrical energy is at a radio frequency and wherein the interior cooling fluid flow passage formed directly adjacent to said bonding region also extends directly adjacent to the outer surface of said conductor tube means throughout its extent within said feedthrough.

* * * * *